US008887612B2

(12) United States Patent
Bayly

(10) Patent No.: US 8,887,612 B2
(45) Date of Patent: Nov. 18, 2014

(54) FIREARM CHARGING HANDLE

(71) Applicant: Timothy K. Bayly, Saskatchewan (CA)

(72) Inventor: Timothy K. Bayly, Saskatchewan (CA)

( * ) Notice: Subject to any disclaimer, the term of this patent is extended or adjusted under 35 U.S.C. 154(b) by 0 days.

(21) Appl. No.: 13/753,693

(22) Filed: Jan. 30, 2013

(65) Prior Publication Data

US 2014/0020549 A1 Jan. 23, 2014

Related U.S. Application Data

(60) Provisional application No. 61/604,050, filed on Feb. 28, 2012.

(51) Int. Cl.
*F41A 3/72* (2006.01)

(52) U.S. Cl.
CPC ..... *F41A 3/72* (2013.01)
USPC ..... 89/1.4

(58) Field of Classification Search
CPC ..... F41A 3/72
USPC ..... 42/108; 89/1.42, 1.4
See application file for complete search history.

(56) References Cited

U.S. PATENT DOCUMENTS 3,225,653 A * 12/1965 Packard ..... 89/1.4
6,311,603 B1 * 11/2001 Dunlap ..... 89/1.4
7,240,600 B1 7/2007 Bordson
8,104,393 B2 1/2012 Kincel
8,356,537 B2 * 1/2013 Kincel ..... 89/1.14
2009/0064556 A1 * 3/2009 Fluhr et al. ..... 42/14

FOREIGN PATENT DOCUMENTS

EP 0 207 058 * 5/1990

* cited by examiner

*Primary Examiner* — Stephen M Johnson
(74) *Attorney, Agent, or Firm* — Gordon & Jacobson, PC

(57) ABSTRACT

An improved charging handle for a firearm, specifically for automatic and semi-automatic rifles, where the charging handle is provided with operator engagement sides generally parallel to the long axis of the charging handle rod. In certain embodiments, the charging handle includes a latch mechanism comprising a non-pivoting pin for engagement with a detent on a firearm exterior surface and a biasing mechanism biasing the pin toward the elongate member, such that when the charging handle assembly is inserted fully into the firearm the pin engages the detent and is held in engagement by the biasing mechanism. In certain other embodiments the charging handle includes a latch mechanism that is rotationally secured to the handle portion and rotatable between a latched orientation and an unlatched orientation, and a biasing mechanism biasing the latch mechanism in the latched orientation and an interface member actuatable for moving the latch mechanism between the latched orientation and the unlatched orientation, wherein the interface member is at an angle to the elongate member when the latch mechanism is in the latched orientation, and the interface member is generally parallel to the elongate member when the latch mechanism is in the unlatched orientation.

24 Claims, 3 Drawing Sheets

FIREARM CHARGING HANDLE

CROSS-REFERENCE TO RELATED APPLICATIONS

The present application claims priority from U.S. Provisional Pat. Appl. No. 61/604,050, filed on Feb. 28, 2012, entitled "FIREARM CHARGING HANDLE", herein incorporated by reference in its entirety.

BACKGROUND

1. Field

The present invention relates to firearms, and specifically to charging handles for automatic and semi-automatic firearms.

2. Related Art

It is known in the art of firearm design to incorporate a charging or cocking handle for ejecting spent cartridges and loading the chamber, the charging handle configured to move the bolt assembly or carrier back and forth by means of a bolt engaging element at a forward end of the charging handle rod. Common charging handles are configured as an elongate rod with a rearward handle disposed in a perpendicular orientation with respect to the rod (commonly described as a "T" shape); the handle is grasped and pulled backward, which moves the rod (and the bolt carrier to which it is engaged) in a rearward direction. It is also known to provide charging handles with latching mechanisms, commonly called tactical latches, to prevent unintended rearward movement of the charging handle during operation or inspection of the weapon. For example, see U.S. Pat. No. 8,104,393 to Kincel and U.S. Pat. No. 7,240,600 to Bordson, which illustrate different versions of a tactical latch. The forward end of the latch engages a detent on the side of the receiver housing, thereby holding the charging handle in position.

Automatic and semi-automatic rifles, called carbines, are gaining in popularity as a firearm of choice for law enforcement agencies, including police departments of larger metropolitan areas. Agencies have begun a shift from issuing shotguns with multiple projectile rounds to M-16 military and civilian variants able to deliver single projectile rounds with improved accuracy and extended distance. Training officers to properly operate a carbine takes many hours, and the officer has to practice the techniques for handling this new weapon through thousands of repetitions to render the handling techniques habitual and instinctive, which is crucial to enable the officer to respond correctly under stressful situations.

While carbines have certain recognized advantages in different situations, problems have been identified with commonly available charging handles. For example, most charging handles have been designed for right-handed operators; supporting the rifle with the left hand, the operator uses two fingers of the right hand (one on either side of the charging handle rod) to pull backwards on the charging handle in a straight line parallel to the bolt carrier of the rifle, requiring the operator to remove the right hand from the weapon trigger. Ambidextrous charging handles have been developed in an attempt to address this, but it has been noted that such handles do not always pull the rod parallel with the bolt carrier as originally designed, but rather cause some degree of rotation and resultant stress on the rod. This creates resistance while trying to pull the bolt carrier to the rear of the weapon, resulting in increased wear on the pin, rod and upper receiver.

In addition, carbines are normally viewed as secondary weapons, with an obvious impact on the training levels required to render proper operation instinctive. Many law enforcement agencies employ a pistol as the primary standard-issue weapon for officers, usually a semi-automatic pistol, and officers undergo intensive training to render operation of such weapons habitual and instinctive. However, charging a semi-automatic pistol involves an overhand grip of the upper rear of the weapon and rearward pull, or a pinch or slingshot grip, which is an entirely different charging motion than is employed with carbine charging handles. As officers are intensively trained with the pistol charging technique, it is therefore obvious that the carbine technique using a charging handle (with or without latch mechanism) will be non-intuitive.

Further, it has been found that common charging handles, with their perpendicular handle positioning, present a potential for snagging on clothing, which can disrupt operation of the firearm at a crucial moment. Certain latch mechanisms extend even further to the sides than the lateral extent of the charging handle, which increases this potential.

What is needed, therefore, is an improved charging handle that addresses the above-identified concerns.

SUMMARY

The present invention therefore seeks to provide a firearm charging handle that allows a more intuitive operation and can optionally incorporate an improved tactical latch mechanism while addressing the issues around some currently available ambidextrous charging handles. Also, the present invention seeks to provide a firearm charging handle that is less likely to snag an operator's clothing during use.

According to one aspect of the present invention, there is provided a charging handle for use with a firearm, the charging handle comprising:

- an elongate member with a forward end and a rearward end;
- a bolt engaging element disposed at the forward end of the elongate member; and
- a handle portion disposed at the rearward end of the elongate member;
- wherein the handle portion is provided with operator engagement sides generally parallel to a long axis of the elongate member.

According to a second aspect of the present invention, there is provided a charging handle assembly for use with a firearm, the charging handle assembly comprising:

- an elongate member with a forward end and a rearward end;
- a bolt engaging element disposed at the forward end of the elongate member;
- a handle portion disposed at the rearward end of the elongate member; and
- a latch mechanism on the handle portion, the latch mechanism comprising:
  - a pin for engagement with a detent on the firearm; and
  - a biasing mechanism biasing the pin toward the elongate member; such that when the charging handle assembly is inserted fully into the firearm, the pin engages the detent and is held in engagement by the biasing mechanism.

According to a third aspect of the present invention, there is provided a charging handle assembly for use with a firearm, the charging handle assembly comprising:

- an elongate member with a forward end and a rearward end;
- a bolt engaging element disposed at the forward end of the elongate member;

a handle portion disposed at the rearward end of the elongate member; and a latch mechanism rotationally secured to the handle portion and rotatable between a latched orientation and an unlatched orientation, the latch mechanism comprising:

a biasing mechanism biasing the latch mechanism in the latched orientation; and an interface member actuatable for moving the latch mechanism between the latched orientation and the unlatched orientation;

wherein the interface member is at an angle to the elongate member when the latch mechanism is in the latched orientation, and the interface member is generally parallel to the elongate member when the latch mechanism is in the unlatched orientation.

A detailed description of exemplary embodiments of the present invention is given in the following. It is to be understood, however, that the invention is not to be construed as being limited to these embodiments.

BRIEF DESCRIPTION OF THE DRAWINGS

In the accompanying drawings, which illustrate exemplary embodiments of the present invention.

Exemplary embodiments of the present invention will now be described with reference to the accompanying drawings.

DETAILED DESCRIPTION OF EXEMPLARY EMBODIMENTS

The present invention has been found to be particularly useful for carbines of Stoner-type firearm systems such as the AR-10, AR-15, M-16 and M4 series, and all subsequent AR-10 type, AR-15 type, M-16 type and M4 type firearms and derivatives thereof. However, it will be recognized by those skilled in the art that the present invention may be applied without undue effort or experimentation to other firearm types.

Figure 1:
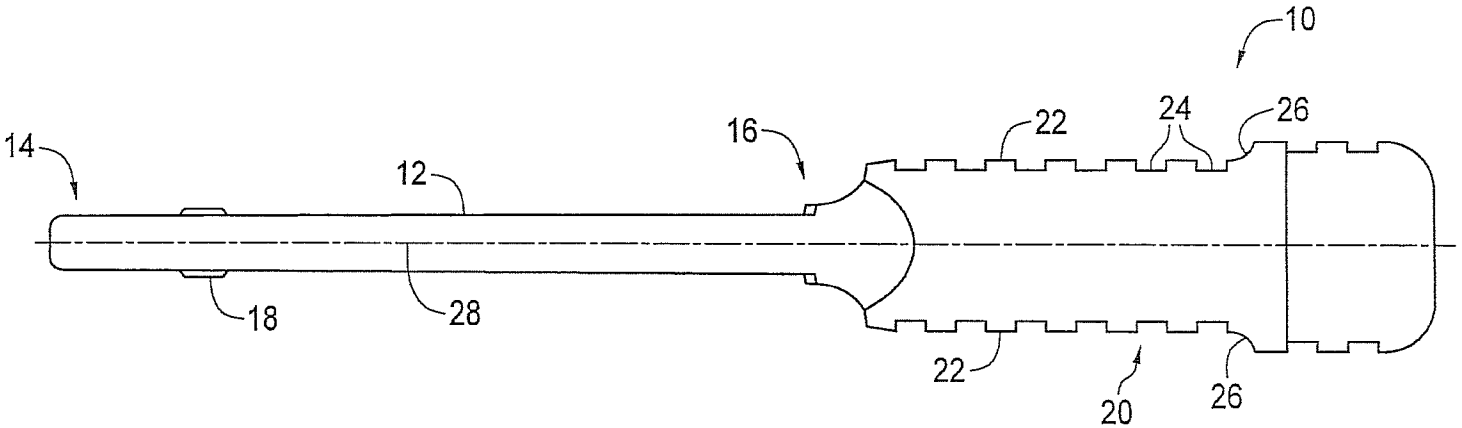
FIG. 1 is a top plan view of a first embodiment of the present invention, illustrating a charging handle without a latch mechanism.

Turning to FIG. 1, a charging handle 10 is illustrated according to a first aspect of the present invention. The charging handle 10 comprises an elongate member or rod 12 having a bolt engaging element 18 disposed at a forward end 14 of the rod 12. At the rearward end 16 of the rod 12, a handle portion 20 is provided for manipulation by the operator. The rod 12, bolt engaging element 18 and handle portion 20 are preferably but not necessarily manufactured in a unitary fashion from anodized aluminum for light weight and strength.

The handle portion 20 is provided with operator engagement sides 22, which are gripped by the operator when wishing to pull the charging handle 10 in a rearward direction. The operator engagement sides 22 are provided with grips or serrations 24 to assist the operator in establishing a firm grip on the handle portion 20. The grips 24 are serrations machined or otherwise provided in the operator engagement sides 22. The handle portion 20 is provided further with angled edges 26 to help ensure that the operator does not lose a firm grip on the handle portion 20. With the low lateral profile of the handle portion 20 and the ability to pull back on the charging handle 10 without an orientation potentially causing rod 12 rotation, the charging handle 10 can be pulled back easily in a direction parallel with the long axis 28 of the rod 12. The operator can grip and rack the charging handle 10 in a manner that is intuitive for one intensively trained in pistol technique, and the low lateral profile has no edges that might snag on the operator's clothing. In addition, the charging handle 10 can be configured to extend rearwardly of the rear scope extent, where a scope is employed on the rifle.

Figure 2:
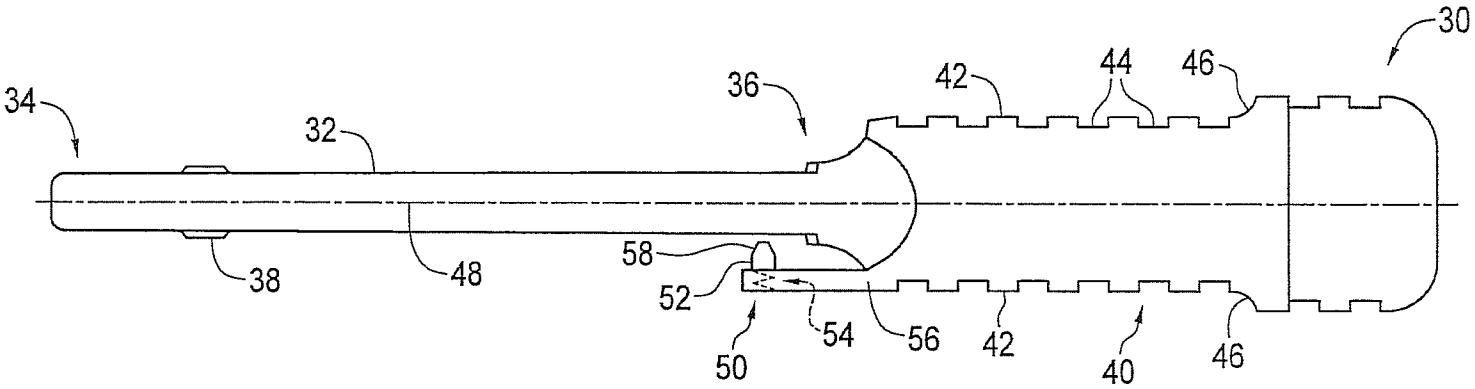
FIG. 2 is a top plan view of a second embodiment of the present invention, illustrating a charging handle with a biased pin latch mechanism.

Turning now to FIG. 2, a charging handle assembly 30 is illustrated according to a second aspect of the present invention. The charging handle assembly 30 comprises an elongate member or rod 32 having a long axis 48 and also a bolt engaging element 38 disposed at a forward end 34 of the rod 32. At the rearward end 36 of the rod 32, a handle portion 40 is provided for manipulation by the operator. The rod 32, bolt engaging element 38 and handle portion 40 are preferably but not necessarily manufactured in a unitary fashion from anodized aluminum for light weight and strength. The handle portion 40 is provided with operator engagement sides 42, which are gripped by the operator when wishing to pull the charging handle assembly 30 in a rearward direction. The operator engagement sides 42 are provided with grips or serrations 44 to assist the operator in establishing a firm grip on the handle portion 40. The grips 44 are serrations machined or otherwise provided in the operator engagement sides 42. The handle portion 40 is provided further with angled edges 46 to help ensure that the operator does not lose a firm grip on the handle portion 40.

The handle portion 40 is further provided with a latch mechanism 50. The latch mechanism 50 comprises a pin 52 for engagement with a detent on the firearm. The pin 52 is biased toward the rod 32 by means of a hidden spring 54, which is housed in a forward extension 56 of the handle portion 40. When the charging handle assembly 30 is fully inserted in the firearm, the pin 52 is engaged in the detent. When the charging handle assembly 30 is moved rearwardly out of full insertion in the firearm, the pin 52 will pass out of the detent and onto the outside of the receiver housing, pressing against the spring 54 until the pin 52 is clear of the housing altogether; the pin 52 is provided with a beveled head 58 to better enable movement of the pin 52 out of the detent. When the charging handle assembly 30 is moved forwardly toward full insertion into the firearm, the pin 52 will pass over the outside of the receiver housing, which will cause the pin 52 to be pressed back against the spring 54, with the beveled head 58 again enabling ease of movement of the pin 52 onto the receiver housing. When the pin 52 passes over the detent, however, it will be biased into the detent by means of the spring 54 and will remain seated in the detent until further operator action.

Figure 3A:
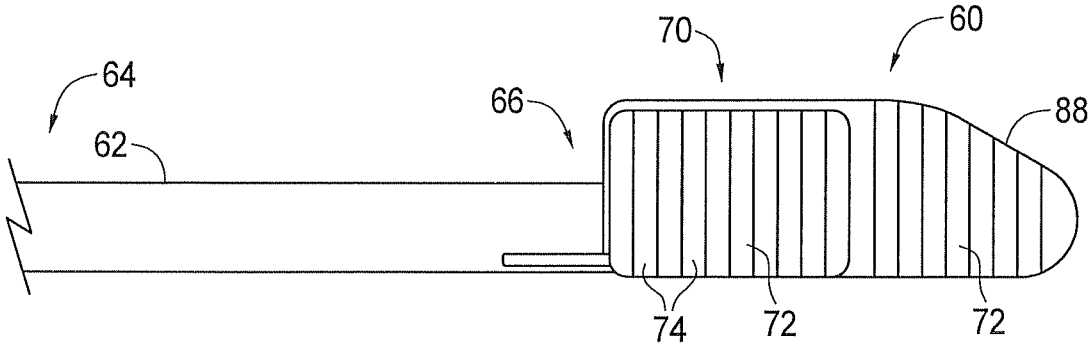
FIG. 3*a* is a side elevation view of a third embodiment of the present invention, illustrating a charging handle with a pivoting latch mechanism.
Figure 3B:
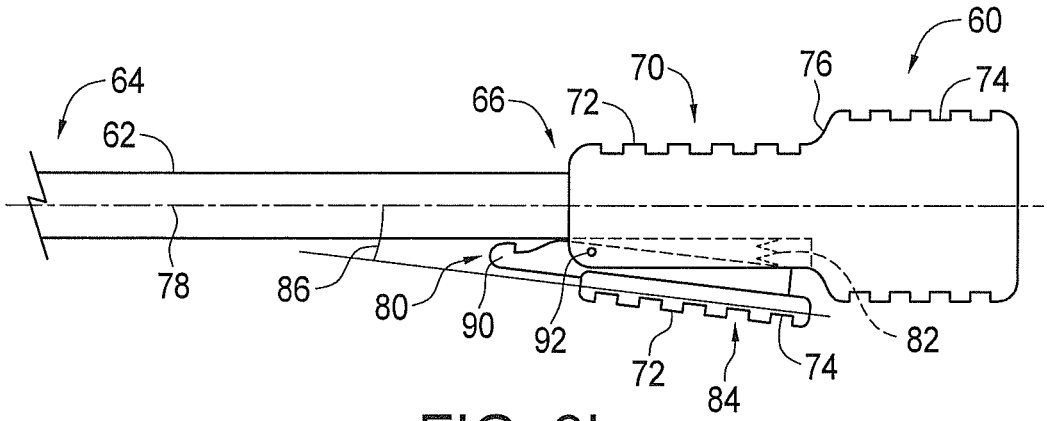
FIG. 3*b* is a top plan view of the third embodiment of the present invention, with the actuator released and the latching mechanism in a latched orientation.
Figure 3C:
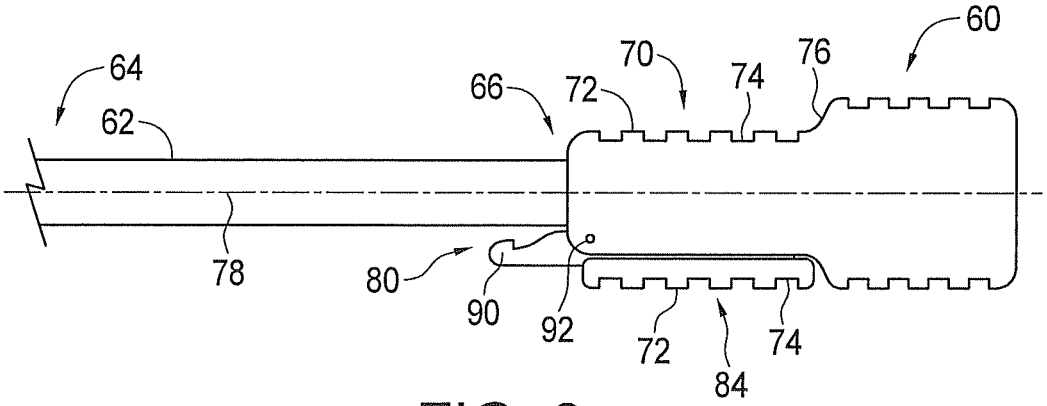
FIG. 3*c* is a top plan view of the third embodiment of the present invention, with the actuator depressed and the latching mechanism in an unlatched orientation.

Turning now to FIGS. 3*a*, 3*b* and 3*c*, a charging handle assembly 60 is illustrated according to a third aspect of the present invention. The charging handle assembly 60 comprises an elongate member or rod 62 having a long axis 78 and also a bolt engaging element (not shown; see FIGS. 1 and 2) disposed at a forward end 64 of the rod 62. At the rearward end 66 of the rod 62, a handle portion 70 is provided for manipulation by the operator. The rod 62, bolt engaging element and handle portion 70 are preferably but not necessarily manufactured in a unitary fashion from anodized aluminum for light weight and strength. The handle portion 70 is provided with operator engagement sides 72, which are gripped by the operator when wishing to pull the charging handle assembly 60 in a rearward direction. The operator engagement sides 72 are provided with grips or serrations 74 to assist the operator in establishing a firm grip on the handle portion 70. The grips 74 are serrations machined or otherwise provided in the operator engagement sides 72. The handle portion 70 is provided further with angled edges 76 to help ensure that the operator does not lose a firm grip on the handle portion 70, as well as a sloped upper surface 88 for comfort and ease of use.

The handle portion 70 is further provided with a latch mechanism 80. The latch mechanism 80 comprises a latch head 90 for engagement with a detent on the firearm. The latch head 90 is biased toward the rod 62 by means of a hidden spring 82 (seen in FIG. 3*b*), which is housed in the handle portion 70. The latch mechanism 80 further comprises an interface member or actuator 84 which the operator can depress to cause rotation of the latch mechanism 80 about a pivot point defined by a roll pin 92 (which pin 92 also holds the latch mechanism 80 engaged to the handle portion 70). The latch mechanism 80 is preferably but not necessarily composed of steel, ⅛ inch thick, with the roll pin 92 preferably but not necessarily ¼ inch long and 1/16 inch in diameter; however, a larger diameter pin may be used for increased strength and durability. When the actuator 84 is not depressed but is left in an outwardly biased position (as seen in FIG. 3*b*), the actuator 84 is at an angle 86 to the long axis 78 of the rod 62, and the latch mechanism 80 is in a latched orientation with the latch head 90 biased toward the rod 62. When the user depresses the actuator 84, the actuator 84 is generally parallel to the rod 12 (as seen in FIG. 3*c*) and the latch mechanism 80 is in an unlatched orientation with the latch head 90 moved away from the rod 62. When the operator wishes to move the charging handle assembly 60 out of full insertion in the firearm, the operator depresses the actuator 84, causing the latch mechanism 80 to rotate about the pin 92 and causing the latch head 90 to move away from the rod 62; depression of the actuator 84 is not necessary for full insertion of the charging handle assembly 60 into the firearm, as the forward edge of the latch head 90 is rounded and when contacted with the receiver housing will move away from the rod 62, with the spring 82 biasing the latch head 90 into the detent when the latch head 90 moves over the detent location.

Figure 4:
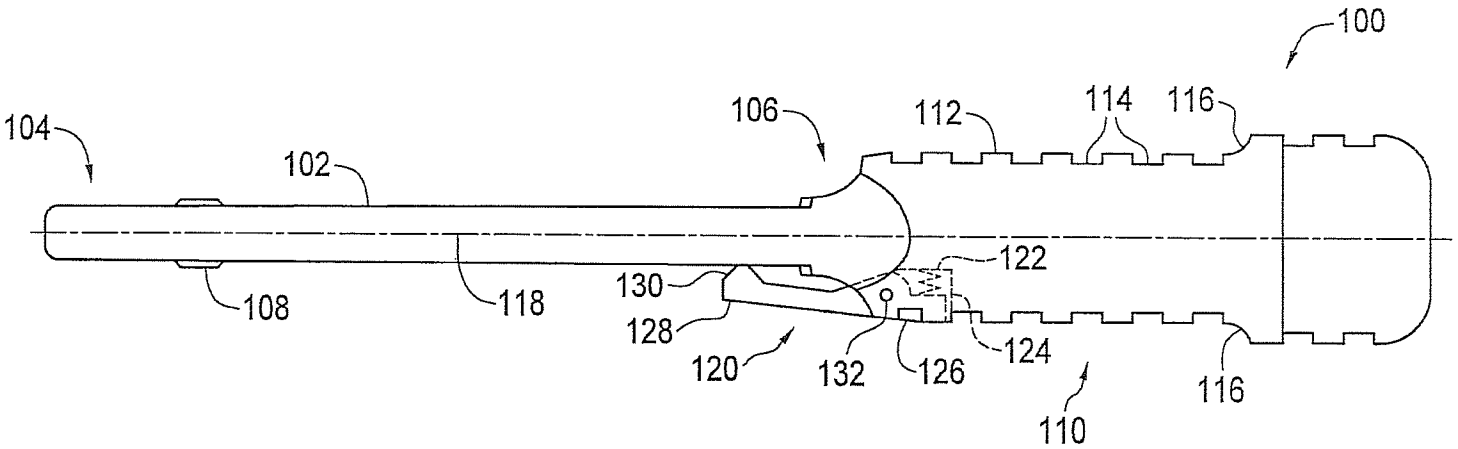
FIG. 4 is a top plan view of a fourth embodiment of the present invention, illustrating a charging handle with an alternative biased pin latch mechanism.

Turning now to FIG. 4, a charging handle assembly 100 is illustrated according to a fourth aspect of the present invention. The charging handle assembly 100 comprises an elongate member or rod 102 having a long axis 118 and also a bolt engaging element 108 disposed at a forward end 104 of the rod 102. At the rearward end 106 of the rod 102, a handle portion 110 is provided for manipulation by the operator. The rod 102, bolt engaging element 108 and handle portion 110 are preferably but not necessarily manufactured in a unitary fashion from anodized aluminum for light weight and strength. The handle portion 110 is provided with operator engagement sides 112, which are gripped by the operator when wishing to pull the charging handle assembly 100 in a rearward direction. The operator engagement sides 112 are provided with grips or serrations 114 to assist the operator in establishing a firm grip on the handle portion 110. The grips 114 are serrations machined or otherwise provided in the operator engagement sides 112. The handle portion 110 is provided further with angled edges 116 to help ensure that the operator does not lose a firm grip on the handle portion 110.

The handle portion 110 is further provided with a latch mechanism 120. The latch mechanism 120 comprises a latch head 128 for engagement with a detent on the firearm. The latch head 128 is biased toward the rod 102 by means of a hidden spring 122 acting against the latch body 126 which is spaced from the latch head 128, the latch body 126 and spring 122 being housed in a slot 124 in the handle portion 110. The latch body 126 is provided with a roll pin 132, enabling the latch mechanism 120 to pivot about the location of the pin 132. When the charging handle assembly 100 is fully inserted in the firearm, the latch head 128 is engaged in the detent. When the charging handle assembly 100 is moved rearwardly out of full insertion in the firearm, the latch head 128 will pass out of the detent and onto the outside of the receiver housing, causing rotation of the latch mechanism 120 about the location of the pin 132 and thereby causing the latch body 126 to press against the spring 122 until the latch head 128 is clear of the housing altogether; the latch head 128 is provided with a beveled contact surface 130 to better enable movement of the latch head 128 out of the detent. When the charging handle assembly 100 is moved forwardly toward full insertion into the firearm, the latch head 128 will pass over the outside of the receiver housing, causing rotation of the latch mechanism 120 about the location of the pin 132 and thereby causing the latch body 126 to press against the spring 122, with the beveled contact surface 130 again enabling ease of movement of the latch head 128 onto the receiver housing. When the latch head 128 passes over the detent, however, it will be biased into the detent by means of the spring 122 causing rotation of the latch mechanism 120 and will remain seated in the detent until further operator action.

As can be readily seen, there are numerous advantages presented by the present invention. For example, use of the charging handle according to the present invention is similar to the pistol charging technique, and is therefore easier to render intuitive through training and reduces training time. As mentioned above, the lower lateral profile reduces the risk of snagging clothing. Also, implementation of the present invention would not require modification of existing firearms. The present invention can also be used by right-handed or left-handed operators, with either an overhand or pinch/slingshot grip to actuate, and it can be used to rack the weapon from any radius, meaning, an upright position or a sideways position. The raised area behind the rifle action also helps protect the operator from gas and debris, in a manner known to those skilled in the art. Finally, the present invention is easy to operate even with gloves or mitts on, and it enables a straight pullback, reducing resistance and wear.

The foregoing is considered as illustrative only of the principles of the invention. The scope of the claims should not be limited by the preferred embodiments set forth in the foregoing examples, but should be given the broadest interpretation consistent with the specification as a whole.

The invention claimed is:

1. A charging handle for use with a firearm, the charging handle comprising:

an elongate member with a forward end and a rearward end;

a bolt engaging element disposed at the forward end of the elongate member; and a handle portion disposed at the rearward end of the elongate member;

wherein the handle portion comprises a forward handle end, a rearward handle end, and operator engagement sides extending the length of the handle portion between the forward handle end and the rearward handle end, the operator engagement sides generally parallel along the length of the handle portion to a long axis of the elongate member;

wherein the elongate member, the bolt engaging element and the handle portion are of unitary construction and composed of anodized aluminum.

2. The charging handle of claim 1, wherein:

the firearm is a carbine.

3. The charging handle of claim 1, wherein:

the elongate member is a rod.

4. The charging handle of claim 1, wherein:

the bolt engaging element is configured to engage a bolt carrier of the firearm.

5. The charging handle of claim 1, wherein:

the operator engagement sides are provided with gripping surfaces for engagement by an operator.

6. A charging handle assembly for use with a firearm, the charging handle assembly comprising:

an elongate member with a forward end and a rearward end;

a bolt engaging element disposed at the forward end of the elongate member;

a handle portion disposed at the rearward end of the elongate member, the handle portion comprising a forward handle end, a rearward handle end, and operator engagement sides extending the length of the handle portion between the forward handle end and the rearward handle end, the operator engagement sides generally parallel along the length of the handle portion to a long axis of the elongate member; and a latch mechanism on the handle portion, the latch mechanism including:

an engagement element configured for engagement with a detent on the firearm, and a biasing mechanism configured to bias the engagement element toward the elongate member.

7. The charging handle assembly of claim 6, wherein:

the firearm is a carbine.

8. The charging handle assembly of claim 6, wherein:

the elongate member is a rod.

9. The charging handle assembly of claim 6, wherein:

the elongate member, the bolt engaging element and the handle portion are of unitary construction and composed of anodized aluminum.

10. The charging handle assembly of claim 6, wherein:

the bolt engaging element is configured to engage a bolt carrier of the firearm.

11. The charging handle assembly of claim 6, wherein:

the operator engagement sides are provided with gripping surfaces for engagement by an operator.

12. The charging handle assembly of claim 6, wherein:

the latch mechanism comprises a member extending in part forwardly of the handle portion, the engagement element located on the member.

13. The charging handle assembly of claim 12, wherein:

the biasing mechanism comprises a spring.

14. The charging handle assembly of claim 12, wherein:

the latch mechanism is pivotably secured to the handle portion, and the biasing mechanism comprises a spring housed within the handle portion to bias the engagement element toward the elongate member.

15. The charging handle assembly of claim 6, wherein:

the detent is a recess in a surface of the firearm.

16. A charging handle assembly for use with a firearm, the charging handle assembly comprising:

an elongate member with a forward end and a rearward end;

a bolt engaging element disposed at the forward end of the elongate member;

a handle portion disposed at the rearward end of the elongate member, the handle portion being provided with operator engagement sides generally parallel to a long axis of the elongate member; and a latch mechanism pivotably secured to the handle portion and pivotable between a latched orientation and an unlatched orientation, the latch mechanism including a biasing mechanism configured to bias the latch mechanism toward the elongate member, and an interface member that is operated to move the latch mechanism between the latched orientation and the unlatched orientation, wherein the interface member is positioned at an angle relative to the elongate member when the latch mechanism is in the latched orientation, and the interface member is positioned generally parallel to the elongate member when the latch mechanism is in the unlatched orientation.

17. The charging handle assembly of claim 16, wherein:

the firearm is a carbine.

18. The charging handle assembly of claim 16, wherein:

the elongate member is a rod.

19. The charging handle assembly of claim 16, wherein:

the elongate member, the bolt engaging element and the handle portion are of unitary construction and composed of anodized aluminum.

20. The charging handle assembly of claim 16, wherein:

the bolt engaging element is configured to engage a bolt carrier of the firearm.

21. The charging handle assembly of claim 16, wherein:

the operator engagement sides are provided with gripping surfaces for engagement by an operator.

22. The charging handle assembly of claim 16, wherein:

the latch mechanism comprises an extension extending in part forwardly of the handle portion, a forward end of the extension comprising a latch head for engaging a detent on the firearm.

23. The charging handle assembly of claim 16, wherein:

the biasing mechanism comprises a spring housed within the handle portion.

24. The charging handle assembly of claim 16, wherein:

the interface member is configured to be depressed against the handle portion by an operator to position the latch mechanism in the unlatched orientation.

* * * * *